US011982503B2

(12) United States Patent
Rorick

(10) Patent No.: US 11,982,503 B2
(45) Date of Patent: May 14, 2024

(54) MODULAR TRIGGER MECHANISM

(71) Applicant: Surefire, LLC, Fountain Valley, CA (US)

(72) Inventor: Steve Rorick, Fountain Valley, CA (US)

(73) Assignee: SureFire, LLC, Fountain Valley, CA (US)

( * ) Notice: Subject to any disclaimer, the term of this patent is extended or adjusted under 35 U.S.C. 154(b) by 341 days.

(21) Appl. No.: 17/334,715

(22) Filed: May 29, 2021

(65) Prior Publication Data

US 2021/0381790 A1 Dec. 9, 2021

Related U.S. Application Data

(60) Provisional application No. 63/034,154, filed on Jun. 3, 2020.

(51) Int. Cl.

| | |
|---|---|
| ***F41A 19/12*** | (2006.01) |
| ***F41A 19/10*** | (2006.01) |
| ***F41A 19/15*** | (2006.01) |
| ***F41A 33/02*** | (2006.01) |
| *F41J 5/14* | (2006.01) |

(52) U.S. Cl.

CPC ..... *F41A 19/15* (2013.01); *F41A 19/10* (2013.01); *F41A 19/12* (2013.01); *F41A 33/02* (2013.01); *F41J 5/14* (2013.01)

(58) Field of Classification Search

CPC ..... F41A 19/44; F41A 19/12
USPC ..... 42/69.01
See application file for complete search history.

(56) References Cited

U.S. PATENT DOCUMENTS

| | | | | |
|---|---|---|---|---|
| 346,941 A * | 8/1886 | Patterson | F41A 19/10 | 42/69.01 |
| 3,177,863 A * | 4/1965 | Spack | F41B 11/51 | 42/69.01 |
| 7,188,561 B1 * | 3/2007 | Kelbly | F41A 19/16 | 89/136 |

* cited by examiner

*Primary Examiner* — Reginald S Tillman, Jr.
(74) *Attorney, Agent, or Firm* — Haynes and Boone, LLP

(57) ABSTRACT

As disclosed herein, the technology relates to firearms including a modular trigger mechanism designed with the capability to provide a practice pistol that accurately and realistically mimics various models of center fire pistols and firearms. In one embodiment, a trigger mechanism comprising a static sear, trigger, and sear bar. In another embodiment, the trigger mechanism provides the user of a practice pistol the realistic sense of a center fire pistol trigger in that its positional geometry, weight of pull, weight at break, and trigger position at disconnect reset point, will perform within a realistic range.

37 Claims, 4 Drawing Sheets

MODULAR TRIGGER MECHANISM

CROSS-REFERENCE TO RELATED APPLICATIONS

The present application claims the benefit of priority under 35 U.S.C. § 119(e) of provisional application Ser. No. 63/034,154, filed Jun. 3, 2020, the contents of which are hereby incorporated by reference.

FIELD OF THE INVENTION

The present disclosure relates to firearms, and more particularly trigger mechanisms and practice firearms.

BACKGROUND OF THE INVENTION

All publications herein are incorporated by reference to the same extent as if each individual publication or patent application was specifically and individually indicated to be incorporated by reference. The following description includes information that may be useful in understanding the present invention. It is not an admission that any of the information provided herein is prior art or relevant to the presently claimed invention, or that any publication specifically or implicitly referenced is prior art.

A long need has existed to provide a trigger mechanism that provides a practice firearm with a trigger feel that is more natural and realistic to the user, including more realistic feedback and trigger action, as well as the ability to more accurately mimic the unique feel of specific firearm models. Practice pistols, or practice firearms in general, are engineered to function like a live, real firearm, and may be used in a variety of contexts such as those who want to train in a simulated combat environment, or prefer to avoid visiting a live fire gun range, for example. By allowing a user to fire a more realistic practice firearm, such as a practice pistol, training and reality based shooting exercises result in increased efficacy and greater improvement by a user when handling a live fire firearm, as well as when engaged in a real world combat environment. Similarly, an improved and more realistic trigger mechanism for practice firearms would provide a more realistic, effective, and enjoyable experience for a user as part of a larger shooting simulator exercise, such as a laser based shooting simulator, or a shot scoring module (SSM) shooting simulator. These advantageous attributes in a practice firearm, such as realistic trigger pull and feel, are desired by and sought after by those who use firearms recreationally, as well as by those in professional law enforcement and military. Thus, there exists a need in the art for an effective and novel trigger mechanism that provides a realistic and accurate experience for the user of a firearm, including a practice pistol.

SUMMARY OF THE INVENTION

Various embodiments include a trigger mechanism for a practice firearm, comprising a static sear operably linked to a trigger. In another embodiment, the practice firearm is modeled after a revolver and/or semi-automatic pistol. In another embodiment, the practice firearm is modeled after a rifle. In another embodiment, the static sear enables the practice firearm to be modeled after a specific live firearm model. In another embodiment, where modeled after the specific live firearm model comprises setting a realistic range of the trigger action so that it matches that experienced in the specific live firearm model. In another embodiment, the specific live firearm model is a pistol. In another embodiment, the specific live firearm model is a rifle. In another embodiment, the specific live firearm model is a 9 mm handgun. In another embodiment, the specific live firearm model is one or more of the following: Glock 19, Browning Hi Power, CZ 75B, Smith & Wesson Shield, Springfield XD(M) Competition Series, Sig Sauer P226, Walther P99 AS, Beretta 92FS, Heckler and Koch VP9, and Ruger SR9.

Other embodiments include a trigger mechanism of a practice firearm, comprising a static sear, and one or more moving components of a practice firearm. In another embodiment, the one or more moving components includes a trigger. In another embodiment, the one or more moving components includes a sear bar. In another embodiment, the practice firearm is a practice pistol. In another embodiment, the practice firearm is a rifle. In another embodiment, the trigger mechanism comprises one or more of the following: a modular trigger housing, laser firing switch, and disconnect switch. In another embodiment, the practice firearm is part of a general practice shooting package, and components thereof. In another embodiment, the practice firearm interfaces with a laser based general practice shooting package. In another embodiment, the practice firearm interfaces with a shot-scoring module (SSM) based general practice shooting package. In another embodiment, the practice firearm is wireless. In another embodiment, the trigger mechanism is depicted in FIG. 1 herein. In another embodiment, the trigger mechanism is depicted in FIGS. 2-6 herein.

Other embodiments include an apparatus, comprising a firearm with a trigger mechanism comprising a static sear, a trigger, and a sear bar. In another embodiment, the apparatus further comprises a torsion spring. In another embodiment, the firearm is a practice firearm. In another embodiment, the practice firearm provides a realistic sense of a center fire pistol trigger in its positional geometry, weight of pull, weight at break, and/or trigger position at disconnect reset point. In another embodiment, the practice firearm can be set to perform at a realistic range of a specific live firearm model. In another embodiment, the specific live firearm model is a Glock. In another embodiment, the specific live firearm model is a 9 mm handgun. In another embodiment, the specific live firearm model is one or more of the following: Glock 19, Browning Hi Power, CZ 75B, Smith & Wesson Shield, Springfield XD(M) Competition Series, Sig Sauer P226, Walther P99 AS, Beretta 92FS, Heckler and Koch VP9, and Ruger SR9. In another embodiment, the specific live firearm is a revolver and/or semi-automatic pistol. In another embodiment, the static sear sets the practice firearm to perform at a realistic range of a specific live firearm model. In another embodiment, the static sear sets the practice firearm to perform at a realistic sense of a specific live firearm modeled on its center fire pistol trigger in its positional geometry, weight of pull, weight at break, and/or trigger position at disconnect reset point. In another embodiment, the specific live firearm is a pistol. In another embodiment, the specific live firearm is a rifle. In another embodiment, the specific live firearm is a revolver and/or semi-automatic pistol. In another embodiment, the specific live firearm is an assault rifle firearm. In another embodiment, the specific live firearm is one or more of the following: Mossberg MMR Pro. Mossberg MMR ProMossberg, JP Rifles SRC-11, JP Rifles SRC-11JP, Savage Arms MSR 10 Long Range, DPMS Prairie Panther, Daniel Defense Ambush 300 Kryptek Highlander, Wilson Combat Ultralight Hunter, DPMS GII Hunter, and Ruger AR-556 450 Bushmaster Model 8522.

Other features and advantages of the invention will become apparent from the following detailed description, taken in conjunction with the accompanying drawings, which illustrate, by way of example, various embodiments of the invention.

DETAILED DESCRIPTION

Figure 1:
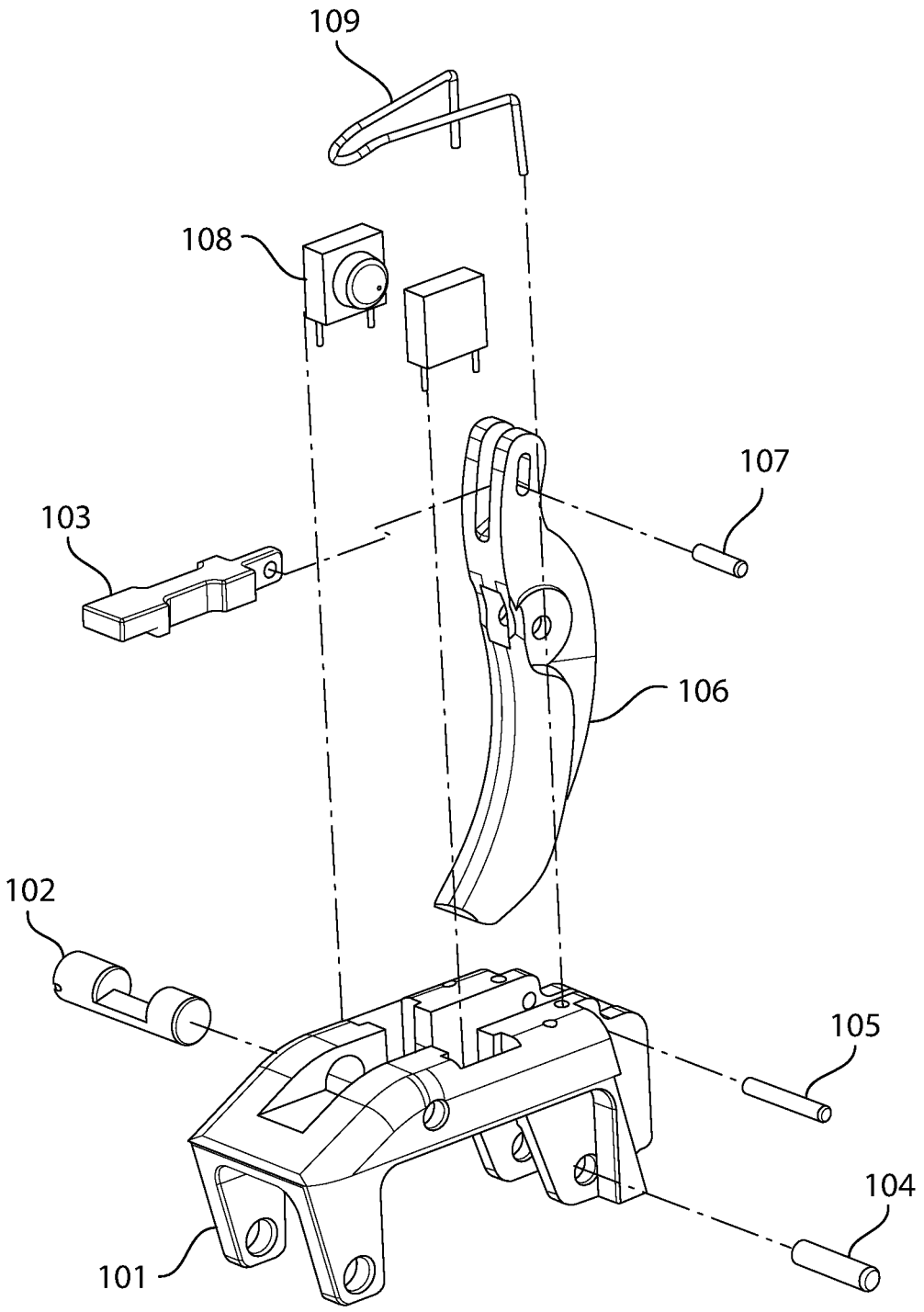
FIG. 1 depicts, in accordance with embodiments herein, an example of a trigger mechanism assembly. A trigger mechanism is depicted to allow greater visibility of relevant components, as well as provide insight on its assembly. In the example illustrated, the trigger mechanism depicts the following components: trigger frame 101, sear ramp 102, sear bar 103, dowell pin 104, trigger limiter pin 105, trigger 106, sear drive pin 107, switch 108, and torsion spring 109.
Figure 2:
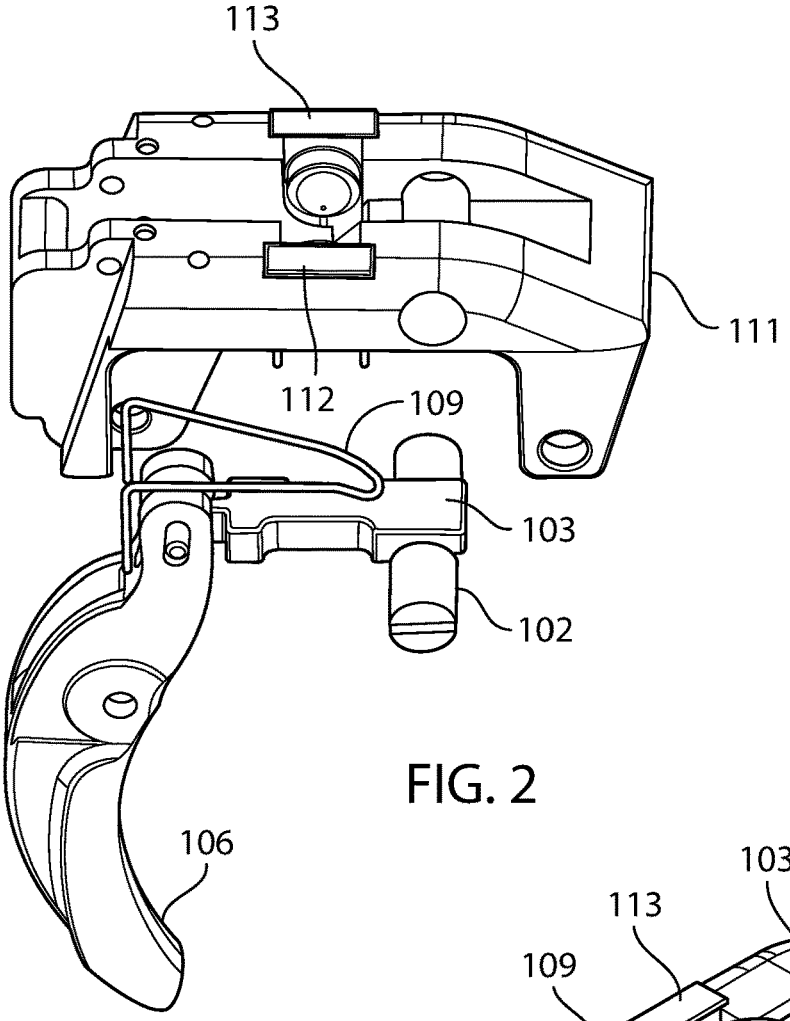
FIG. 2 depicts, in accordance with embodiments herein, an example of a trigger mechanism.
Figure 3:
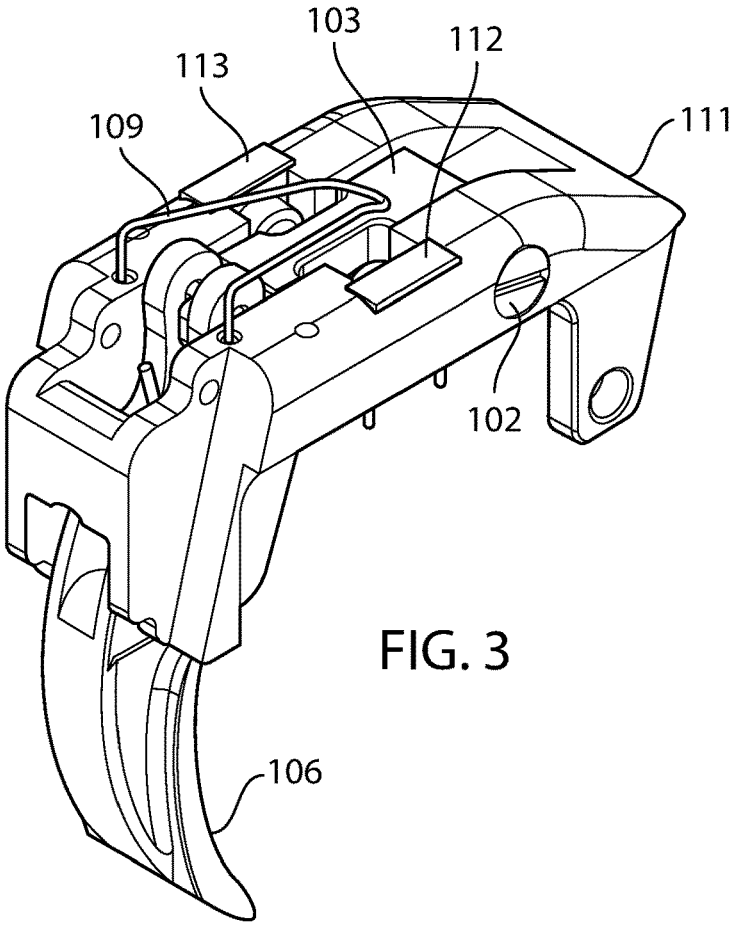
FIG. 3 depicts, in accordance with embodiments herein, an example of a trigger mechanism.
Figure 4:
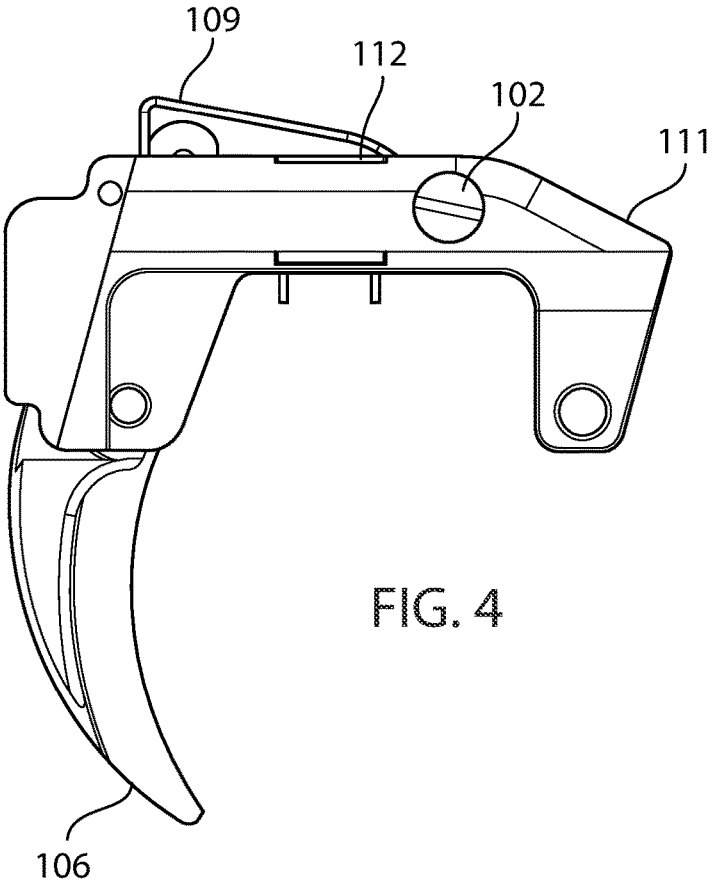
FIG. 4 depicts, in accordance with embodiments herein, an example of a trigger mechanism.
Figure 5:
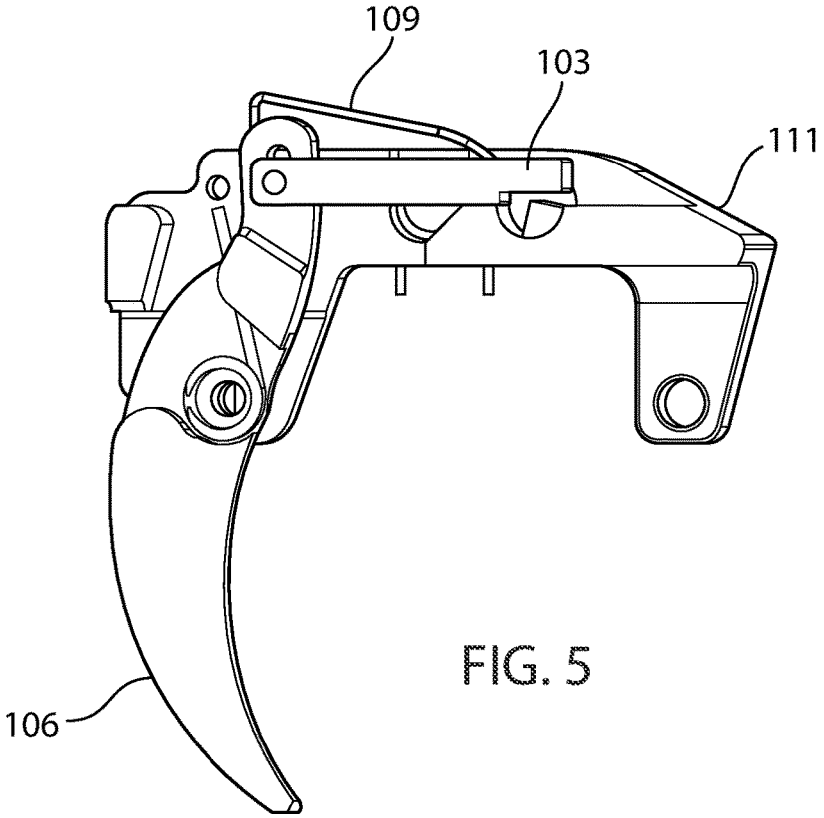
FIG. 5 depicts, in accordance with embodiments herein, an example of a trigger mechanism.
Figure 6:
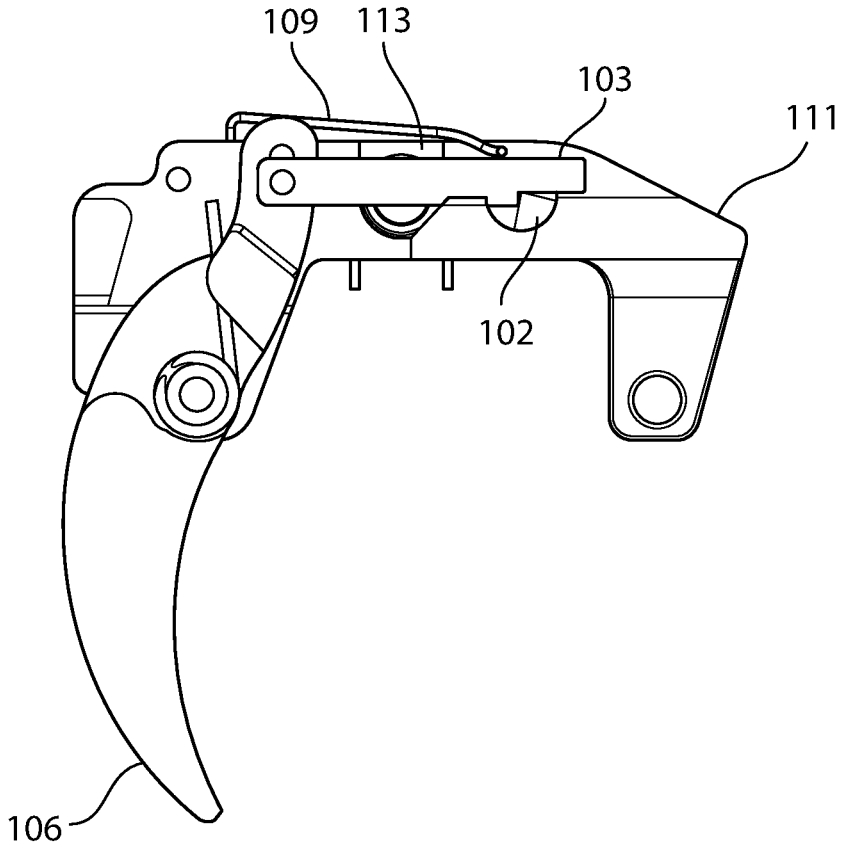
FIG. 6 depicts, in accordance with embodiments herein, an example of a trigger mechanism.

All references, publications, and patents cited herein are incorporated by reference in their entirety as though they are fully set forth. Unless defined otherwise, technical and scientific terms used herein have the same meaning as commonly understood by one of ordinary skill in the art to which this invention belongs. Advanced Gunsmithing: A Manual of Instruction in the Manufacture, Alteration, and Repair of Firearms (75th Anniversary Edition—Feb. 17, 2015), W. F. Vickery provide one skilled in the art with a general guide to many of the terms used in the present application. One skilled in the art will recognize many methods and materials similar or equivalent to those described herein, which could be used in the practice of the present invention. Indeed, the present invention is in no way limited to the methods and materials described.

As used herein, the term "modular trigger mechanism," also includes apparatuses that may be referred to as a "trigger mechanism."

As used herein, the abbreviation "SSM" refers to shot-scoring module, and/or self-scoring module.

As used herein, the term "static sear" refers to a sear component of a trigger mechanism that is a non-movable component and does not rotate.

As used herein, the terms "firearm," and "gun," are used interchangeably.

As used herein, the term "practice pistol," refers to an apparatus intended and designed to mimic or replicate or simulate a live action pistol or firearm, including but not limited to a center fire pistol or rifle. Similarly, the term "practice firearm," refers to an apparatus intended to be used to mimic or replicate or simulate a live action firearm.

As used herein, "specific live firearm model" refers to a live action firearm that is of the model that a practice firearm is intended to mimic or replicate.

As further disclosed herein, modular trigger mechanisms in accordance with various embodiments herein have been designed so that they may improve user feel and trigger action for practice firearms. For example, a practice firearm may be designed so that it has the capability to mimic for a user various center fire pistols, including many of those live action firearms currently commercially available, such as a Glock 17, Sig P320, or 1911, for example. In accordance with various embodiments herein, trigger mechanisms may be designed with the capability to perform and give the user a sense of a center fire pistol trigger. In another embodiment, trigger mechanisms may be designed with the capability to perform and give the user a sense of a center fire pistol trigger in that its positional geometry, weight of pull, weight at break, and trigger position at disconnect reset point, for example, will perform within a realistic range. In another embodiment, the realistic range is a range that serves to mimic for the user a type of center fire pistol. In another embodiment, the apparatus interacts with electronics within a practice pistol to provide feedback and/or data to the user. In another embodiment, the apparatus interacts with a practice pistol to provide a shot scoring system.

Turning to FIGS. 1-6, in accordance with various embodiments herein, examples are depicted of trigger mechanisms. FIG. 1 in particular provides visibility of components, as well as provide insight on assembly.

In one embodiment, the present invention provides an apparatus comprising a static sear 102 and a first moving part and/or a second moving part. In another embodiment, the first moving part is a trigger 106. In another embodiment, the second moving part is a sear bar 103. In another embodiment, the static sear 102 can be rotated within a range to alter break weight at the trigger 106, but is static during firing sequences. In accordance with various embodiments herein, the apparatus provides a modular design that allows various present characteristics to be interchangeable to the frame. In another embodiment, the apparatus interacts with a circuit board. In another embodiment, the apparatus interacts with a circuit board by one or two tactile switches to achieve various electronic effects.

Unlike trigger mechanisms used for alternative, otherwise commercially available firearms or practice pistols, embodiments herein incorporate a static sear 102 component. The static sear 102 provides for no rotation of the sear, which enables a trigger mechanism with fewer moving parts. A trigger mechanism with fewer moving parts provides various advantages in the art, such as cost advantage, greater dependability, and modularity. Additionally, in accordance with various embodiments herein, use of a static sear 102, sear bar 103, and torsion spring 109, and combinations thereof, as components of a trigger mechanism in conjunction with a practice pistol, provide a more realistic and accurate experience for a user when firing a practice pistol, compared to alternative, otherwise commercially available practice pistols with corresponding trigger mechanisms.

Similarly, as known to those of skill in the art, each model of firearm can have a unique and specific feel to the user when firing that model of firearm. Thus, in accordance with various embodiments herein, use of a static sear 102, sear bar 103, and torsion spring 109, and combinations thereof, enable greater tunability of feedback for the user of a practice pistol, or practice firearm, relative to alternative, commercially available practice pistols and trigger mechanisms, thus allowing the ability of a user to experience a feel when firing the practice pistol that accurately and reliably mimics specific firearm models as desired by the user.

Other alternative practice pistols in the prior art rely on a traditional trigger design, and may then attempt to influence its characteristics by use of an electromagnet. In contrast, various embodiments herein provide a trigger mechanism that incorporates a non-traditional, static sear for its trigger design. Similarly, rather than attempting to influence its characteristics through use of an electromagnet, various embodiments herein influence its characteristics mechanically and/or by trigger weight. In one embodiment, the present invention provides a trigger mechanism comprising a static sear 102, wherein friction, or break weight, at opposing junctions is influenced by the angle of a static sear ramp 102, and the force of a torsion spring 109 baring downward on a sear bar 103 as its force against the static sear 102 by a trigger 106, so that when sufficient force is applied by the user to the trigger 106 to overcome the resistance, or friction, the sear bar 103 advances abruptly to give the user the impression of a traditional sear mechanism. In another embodiment, the trigger mechanism includes an electromechanical aspect that provides tactile feedback to the user with no imparted influence to the trigger break.

In one embodiment, the practice pistol is part of a general practice shooting package, and components thereof. In one embodiment, the trigger mechanism is adapted for use in a practice pistol that interfaces with a laser-based interface, as part of a larger, general practice shooting package, and various components thereof. In another embodiment, the trigger mechanism is adapted for use in a practice pistol that interfaces with a shot-scoring module (SSM), as part of a larger, general practice shooting package, and various components thereof. In another embodiment, the trigger mechanism is adapted for use in a practice pistol that is wireless.

Further, as readily apparent to one of skill in the art, a trigger mechanism may serve as an apparatus that is to be used as a part of, or component of, a firearm, such as a center fire pistol or a rifle. Or, for example, in accordance with various embodiments herein, the trigger mechanism may also serve as an apparatus that is part of, or component of, a practice firearm. Thus, as apparent to one of skill in the art, the application is in no way limited to only modular trigger mechanisms to be used for practice pistols, and may instead also be used as a trigger mechanism that is a part of an active, real firearm. Similarly, the application is in no way limited for use in only firearms that are center fire pistols, and may include and be adapted for use in other types of firearms, such as rifles. Similarly, the application is in no way limited to only practice pistols modeled after center fire pistols, and may also be used as part of a practice firearm modeled after other types of firearms, such as rifles. Or, as readily apparent to one of skill in the art, the firearms are in no way limited to only the specific models explicitly stated herein. For example, various embodiments herein may be used for, or modeled after, any number of 9 mm handgun firearms, including but not limited to: Glock 19, Browning Hi Power, CZ 75B, Smith & Wesson Shield, Springfield XD(M) Competition Series, Sig Sauer P226, Walther P99 AS, Beretta 92FS, Heckler and Koch VP9, and Ruger SR9. Or, for example, various embodiments herein may be used for, or modeled after, any number of assault rifle firearms including but not limited to: Mossberg MMR Pro. Mossberg MMR ProMossberg, JP Rifles SRC-11, JP Rifles SRC-11JP, Savage Arms MSR 10 Long Range, DPMS Prairie Panther, Daniel Defense Ambush 300 Kryptek Highlander, Wilson Combat Ultralight Hunter, DPMS GII Hunter, and Ruger AR-556 450 Bushmaster Model 8522.

While particular embodiments of the present invention have been shown and described, it will be obvious to those skilled in the art that changes and modifications may be made without departing from this invention in its broader aspects.

Other features and advantages of the invention will become apparent from the following detailed description, taken in conjunction with the accompanying drawings, which illustrate, by way of example, various embodiments of the invention.

EXAMPLES

Example 1

FIGS. 1-6

Referring to FIG. 1, a trigger mechanism is depicted to allow greater visibility of relevant components, as well as provide insight on its assembly. In the example illustrated in FIG. 1, in accordance with various embodiments herein, the trigger mechanism depicts the following components: trigger frame 101, sear ramp 102, sear bar 103, dowell pin 104, trigger limiter pin 105, trigger 106, sear drive pin 107, switch 108, and torsion spring 109.

Referring now to FIGS. 2-6, various perspectives are provided of a trigger mechanism in accordance with various embodiments herein. In one embodiment, as depicted in FIGS. 2-6, the trigger mechanism depicts the following components: static sear 102, modular trigger housing 111, laser firing switch 112, disconnect switch (reset) 113, sear bar 103, and torsion spring 109. In one embodiment, the laser firing switch 112 and disconnect switch (reset) 113, are electrical interface components. In another embodiment, the static sear 102, modular trigger housing 111, sear bar 103, and torsion spring 109, are mechanical components.

The various methods and techniques described above provide a number of ways to carry out the invention. Of course, it is to be understood that not necessarily all objectives or advantages described may be achieved in accordance with any particular embodiment described herein. Thus, for example, those skilled in the art will recognize that the methods can be performed in a manner that achieves or optimizes one advantage or group of advantages as taught herein without necessarily achieving other objectives or advantages as may be taught or suggested herein. A variety of advantageous and disadvantageous alternatives are mentioned herein. It is to be understood that some preferred embodiments specifically include one, another, or several advantageous features, while others specifically exclude one, another, or several disadvantageous features, while still others specifically mitigate a present disadvantageous feature by inclusion of one, another, or several advantageous features.

Furthermore, the skilled artisan will recognize the applicability of various features from different embodiments. Similarly, the various elements, features and steps discussed above, as well as other known equivalents for each such element, feature or step, can be mixed and matched by one of ordinary skill in this art to perform methods in accordance with principles described herein. Among the various elements, features, and steps, some will be specifically included and others specifically excluded in diverse embodiments.

Although the invention has been disclosed in the context of certain embodiments and examples, it will be understood by those skilled in the art that the embodiments of the invention extend beyond the specifically disclosed embodiments to other alternative embodiments and/or uses and modifications and equivalents thereof Many variations and alternative elements have been disclosed in embodiments of the present invention. Still further variations and alternate elements will be apparent to one of skill in the art. Among these variations, without limitation, are the selection of constituent modules. Various embodiments of the invention can specifically include or exclude any of these variations or elements.

In some embodiments, the terms "a," "an," and "the" and similar references used in the context of describing a particular embodiment of the invention (especially in the context of certain of the following claims) can be construed to cover both the singular and the plural. The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Preferred embodiments of this invention are described herein, including the best mode known to the inventors for carrying out the invention. Variations on those preferred embodiments will become apparent to those of ordinary skill in the art upon reading the foregoing description. It is contemplated that skilled artisans can employ such variations as appropriate, and the invention can be practiced otherwise than specifically described herein. Accordingly, many embodiments of this invention include all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

In closing, it is to be understood that the embodiments of the invention disclosed herein are illustrative of the principles of the present invention. Other modifications that can be employed can be within the scope of the invention. Thus, by way of example, but not of limitation, alternative configurations of the present invention can be utilized in accordance with the teachings herein. Accordingly, embodiments of the present invention are not limited to that precisely as shown and described.

What is claimed is:

1. A trigger mechanism for a practice firearm, comprising:
a trigger;
a static sear ramp, operably linked to the trigger;
a sear bar moveably secured to the trigger, wherein the sear bar is configured to bias against the static sear ramp; and
wherein, upon a user actuation of the trigger, the sear bar is configured to advance past the static sear ramp.

2. The trigger mechanism of claim 1, wherein the practice firearm is modeled after a revolver and/or semi-automatic pistol.

3. The trigger mechanism of claim 1, wherein the practice firearm is modeled after a rifle.

4. The trigger mechanism of claim 1, wherein the static sear ramp enables the practice firearm to be modeled after a specific live firearm model.

5. The trigger mechanism of claim 4, wherein modeled after the specific live firearm model comprises setting a realistic range of the trigger action so that it matches that experienced in the specific live firearm model.

6. The trigger mechanism of claim 5, wherein the specific live firearm model is a pistol.

7. The trigger mechanism of claim 5, wherein the specific live firearm model is a rifle.

8. The trigger mechanism of claim 5, wherein the specific live firearm model is a 9 mm handgun.

9. The trigger mechanism of claim 5, wherein the specific live firearm model is one or more of the following: Glock 19, Browning Hi Power, CZ 75B, Smith & Wesson Shield, Springfield XD(M) Competition Series, Sig Sauer P226, Walther P99 AS, Beretta 92F S, Heckler and Koch VP9, and Ruger SR9.

10. The trigger mechanism of claim 1, wherein the practice firearm is a practice pistol.

11. The trigger mechanism of claim 1, wherein the practice firearm is a rifle.

12. The trigger mechanism of claim 1, further comprising one or more of the following:
a modular trigger housing, laser firing switch, and disconnect switch.

13. The trigger mechanism of claim 1, wherein the practice firearm is part of a general practice shooting package, and components thereof.

14. The trigger mechanism of claim 13, wherein the practice firearm interfaces with a laser based general practice shooting package.

15. The trigger mechanism of claim 13, wherein the practice firearm interfaces with a shot-scoring module (SSM) based general practice shooting package.

16. The trigger mechanism of claim 1, wherein the practice firearm is wireless.

17. The trigger mechanism of claim 1, as depicted in FIG. 1 herein.

18. The trigger mechanism of claim 1, as depicted in FIGS. 2-6 herein.

19. An apparatus, comprising:
a firearm with a trigger mechanism, the trigger mechanism comprising:
a trigger;
a static sear ramp;
a sear bar moveably secured to the trigger, wherein the sear bar is configured to bias against the static sear ramp; and
wherein, upon a user actuation of the trigger, the sear bar is configured to advance past the static sear ramp.

20. The apparatus of claim 19, further comprising a torsion spring, wherein, upon the user actuation, the torsion spring is configured to bias against the sear bar.

21. The apparatus of claim 19, wherein the firearm is a practice firearm.

22. The apparatus of claim 21, wherein the practice firearm provides a realistic sense of a center fire pistol trigger in its positional geometry, weight of pull, weight at break, and/or trigger position at disconnect reset point.

23. The apparatus of claim 21, wherein the practice firearm can be set to perform at a realistic range of a specific live firearm model.

24. The apparatus of claim 23 wherein the specific live firearm model is a Glock.

25. The apparatus of claim 23, wherein the specific live firearm model is a 9 mm handgun.

26. The apparatus of claim 23, wherein the specific live firearm model is one or more of the following: Glock 19, Browning Hi Power, CZ 75B, Smith & Wesson Shield, Springfield XD(M) Competition Series, Sig Sauer P226, Walther P99 AS, Beretta 92F S, Heckler and Koch VP9, and Ruger SR9.

27. The apparatus of claim 23, wherein the specific live firearm is a revolver and/or semiautomatic pistol.

28. The apparatus of claim 21, wherein the static sear sets the practice firearm to perform at a realistic range of a specific live firearm model.

29. The apparatus of claim 21, wherein the static sear ramp sets the practice firearm to perform at a realistic sense of a specific live firearm modeled on its center fire pistol trigger in its positional geometry, weight of pull, weight at break, and/or trigger position at disconnect reset point.

30. The apparatus of claim 29, wherein the specific live firearm is a pistol.

31. The apparatus of claim 29, wherein the specific live firearm is a rifle.

32. The apparatus of claim 29, wherein the specific live firearm is a revolver and/or semiautomatic pistol.

33. The apparatus of claim 29, wherein the specific live firearm is an assault rifle firearm.

34. The apparatus of claim 29, wherein the specific live firearm is one or more of the following: Mossberg MMR Pro. Mossberg MMR ProMossberg, JP Rifles SRC-11, JP Rifles SRC-11JP, Savage Arms MSR 10 Long Range, DPMS Prairie Panther, Daniel Defense Ambush 300 Kryptek Highlander, Wilson Combat Ultralight Hunter, DPMS GII Hunter, and Ruger AR-556 450 Bushmaster Model 8522.

35. The trigger mechanism of claim 1, further comprising a torsion spring, wherein, upon the user actuation, the torsion spring is configured to bias against the sear bar.

36. The trigger mechanism of claim 1, wherein the static sear ramp is configured to be rotated to adjust an angle of the static sear ramp, altering a break weight at the trigger.

37. The apparatus of claim 19, wherein the static sear ramp is configured to be rotated to adjust an angle of the static sear ramp, altering a break weight at the trigger.

* * * * *